US006823762B2

(12) United States Patent
Hu

(10) Patent No.: US 6,823,762 B2
(45) Date of Patent: Nov. 30, 2004

(54) WRENCH EXTENSION WITH A SOCKET-COUPLING SYSTEM

(76) Inventor: Bobby Hu, No. 180, Jong-Ching Road, Shi Twen District, Taichung (TW)

( * ) Notice: Subject to any disclaimer, the term of this patent is extended or adjusted under 35 U.S.C. 154(b) by 0 days.

(21) Appl. No.: 10/300,248

(22) Filed: Nov. 20, 2002

(65) Prior Publication Data

US 2003/0110907 A1 Jun. 19, 2003

(30) Foreign Application Priority Data

Dec. 14, 2001 (TW) ..... 90222164 U

(51) Int. Cl.[7] ..... B25B 23/16

(52) U.S. Cl. ..... 81/177.85; 403/322.2; 403/325; 81/177.2

(58) Field of Search ..... 81/177.85, 177.2, 81/177.1; 403/321, 322.1, 322.2, 325, 324, 328

(56) References Cited

U.S. PATENT DOCUMENTS

| | | | | |
|---|---|---|---|---|
| 2,162,359 A | | 6/1939 | Rhinevault | |
| 3,208,318 A | | 9/1965 | Roberts | |
| 3,924,493 A | | 12/1975 | Penner | |
| 4,614,457 A | | 9/1986 | Sammon | |
| 4,865,485 A | * | 9/1989 | Finnefrock, Sr. | 403/322.2 |
| 4,962,682 A | | 10/1990 | Rose et al. | |
| 5,390,571 A | | 2/1995 | Fox, III et al. | |
| 5,531,140 A | | 7/1996 | Chow | |
| 6,523,441 B2 | * | 2/2003 | Lee | 81/177.85 |

FOREIGN PATENT DOCUMENTS

| | | |
|---|---|---|
| TW | 349462 | 8/1998 |
| TW | 349463 | 8/1998 |

* cited by examiner

*Primary Examiner*—Hadi Shakeri
(74) *Attorney, Agent, or Firm*—Alan D. Kamrath; Nikolai & Mersereau, P.A.

(57) ABSTRACT

A wrench extension with a socket-coupling system includes a socket extension shaft, a transmission member mounted in an axial passageway in an end of the wrench extension shaft, a ball mounted in a first transverse passageway in the end of the wrench extension shaft, and a push member mounted in a second transverse passageway in the wrench extension shaft. The transmission member includes a sliding portion that is in sliding contact with a sliding portion of the push member for urging the ball into a detent of a cavity of a socket coupled to the end of the wrench extension shaft. When the socket is subject to an axial force away from the wrench extension shaft, the transmission member is stopped by the push member to thereby prevent undesired decoupling of the socket.

20 Claims, 14 Drawing Sheets

WRENCH EXTENSION WITH A SOCKET-COUPLING SYSTEM

BACKGROUND OF THE INVENTION

1. Field of the Invention

The present invention relates to a wrench extension with a socket-coupling system allowing quick attachment/detachment of a socket to/from an end of the wrench extension shaft.

2. Description of the Related Art

U.S. Pat. No. 5,531,140 discloses a coupling mechanism of socket wrench extension including an extension shaft (body). A first transverse passageway (opening) is defined in an end of the extension shaft and extends radially. A second transverse passageway (orifice) is defined in the extension shaft and adjacent to the end of the extension shaft. An axial passageway (axial bore) extends longitudinally from an end face of the end of the extension shaft and communicates with the first transverse passageway and the second transverse passageway. A transmission member (rod) is mounted in the axial passageway, and a spring is mounted in an inner end of the axial passageway with two ends of the spring respectively attached to an end wall defining the axial passageway and an end face of the transmission member. A stepped portion consisting of a cavity and a depression is formed on an outer end of the transmission member, and a cutout (aperture) is defined in an inner end of the transmission member. A push button (actuator) is slidingly received in the second transverse passageway with an end of the push button located outside the second transverse passageway for manual depression. The push button includes an inner hooked end (lateral projection) that extends through the cutout of the transmission member and an inclined face (tapered surface) above the hooked end. When the push button is in a normal undepressed position, the transmission member is biased outward by the spring such that a ball in the first transverse passageway is moved outward by the depression of the transmission member. When the push button is pushed, the inclined face of the push member urges the transmission member to move inward and compress the spring. The ball moves inward into the cavity of the transmission member, allowing insertion of the end of the extension shaft into a cavity (not shown) of a socket (not shown) or removal of the end of the extension shaft from the cavity of the socket. When the push button is released, the push button and the transmission member return to their original position. The protruded portion of the ball is engaged in a detent in the cavity of the socket, thereby coupling the socket to the end of the extension shaft.

Nevertheless, when the socket coupled to the end of the extension shaft is subject to an external force and thus moves in a direction away from the extension shaft, the ball is forced to move downward and causes inward movement of the transmission member. This is because no retaining means is provided for retaining the transmission member and the push button in place. Further, the stepped portion consisting of a cavity and a depression could not be used with all sockets due to tolerances. More specifically, the dimensions of the sockets manufactured by different manufacturers are slightly different from one another due to tolerances. As a result, the protruded portion of the ball may be either too large or too small for the detents of the cavities of the sockets. The socket would wobble relative to the end of the extension shaft when the user grips and applies an axial force to the socket. A reliable engagement between the end of the extension shaft and the socket regardless of the tolerance could not be obtained.

U.S. Pat. No. 4,962,682 discloses a wrench extension and socket coupler in which balls or a rod is used as the transmission member. In addition to the unreliable coupling resulting from tolerance in the detent of the cavity of the socket, the protruded height of the latch (also in the form of a ball) of the respective wrench extension may be different from each other, as the protruded height of the ball-like latch is affected by the tolerance of the balls. In some cases, the ball-like latch fails to protrude beyond the end of the wrench extension shaft.

SUMMARY OF THE INVENTION

An object of the present invention is to provide a wrench extension with a socket-coupling system allowing quick attachment/detachment of a socket to/from an end of the wrench extension and providing reliable coupling of the socket to the end of the wrench extension shaft.

A socket-coupling system in accordance with the present invention comprises:

a wrench extension shaft including an end, the end including an axial passageway extending along a longitudinal direction of the wrench extension shaft, the end further including a first transverse passageway extending in a direction transverse to the longitudinal direction of the wrench extension shaft, the first transverse passageway including an inner end communicated with the axial passageway and an outer end communicated with outside, the wrench extension shaft further including a second transverse passageway defined in an outer periphery thereof and extending in a direction transverse to the longitudinal direction of the wrench extension shaft, the second transverse passageway being communicated with the axial passageway and having an outer end communicated with outside;

a transmission member mounted in the axial passageway and slidable along the longitudinal direction of the wrench extension shaft, the transmission member including a recessed portion in an outer periphery thereof, the inner end of the transmission member including a sliding portion;

a latch partially received in the first transverse passageway and movable along an extending direction of the first transverse passageway, the latch being partially received in the recessed portion of the transmission member;

a push member mounted in the second transverse passageway and slidable along an extending direction of the second transverse passageway, the push member including an operative section having a sliding portion in sliding engagement with the sliding portion of the transmission member allowing mutual sliding movement between the sliding portion of the push member and the sliding portion of the transmission member; and an elastic element mounted in the second transverse passageway for biasing the push member to an undepressed position;

one of the push member and the inner end of the transmission member including a pressing face;

wherein when the push member is pushed and a socket is coupled to the end of the wrench extension shaft, the latch is moved inward to allow passage of the socket, and the transmission member is moved by the latch along the longitudinal direction of the wrench extension shaft, and when the push member is released, the transmission member is moved along the longitudinal direction of the wrench extension shaft in response to movement of the push member under action of the elastic element until the recessed portion of the transmission member urges the latch to protrude into a detent of a cavity of the socket coupled to the end of the wrench extension shaft; and wherein when the socket is subject to a force along the longitudinal direction of the wrench extension shaft for moving the socket away from the end of the wrench extension shaft, the pressing face on said one of the push member and the inner end of the transmission member being stopped by the other of the push member and the inner end of the transmission member, thereby preventing further movement of the transmission member along the longitudinal direction of the wrench extension shaft and reliably retaining a protruded portion of the latch in the detent of the socket.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
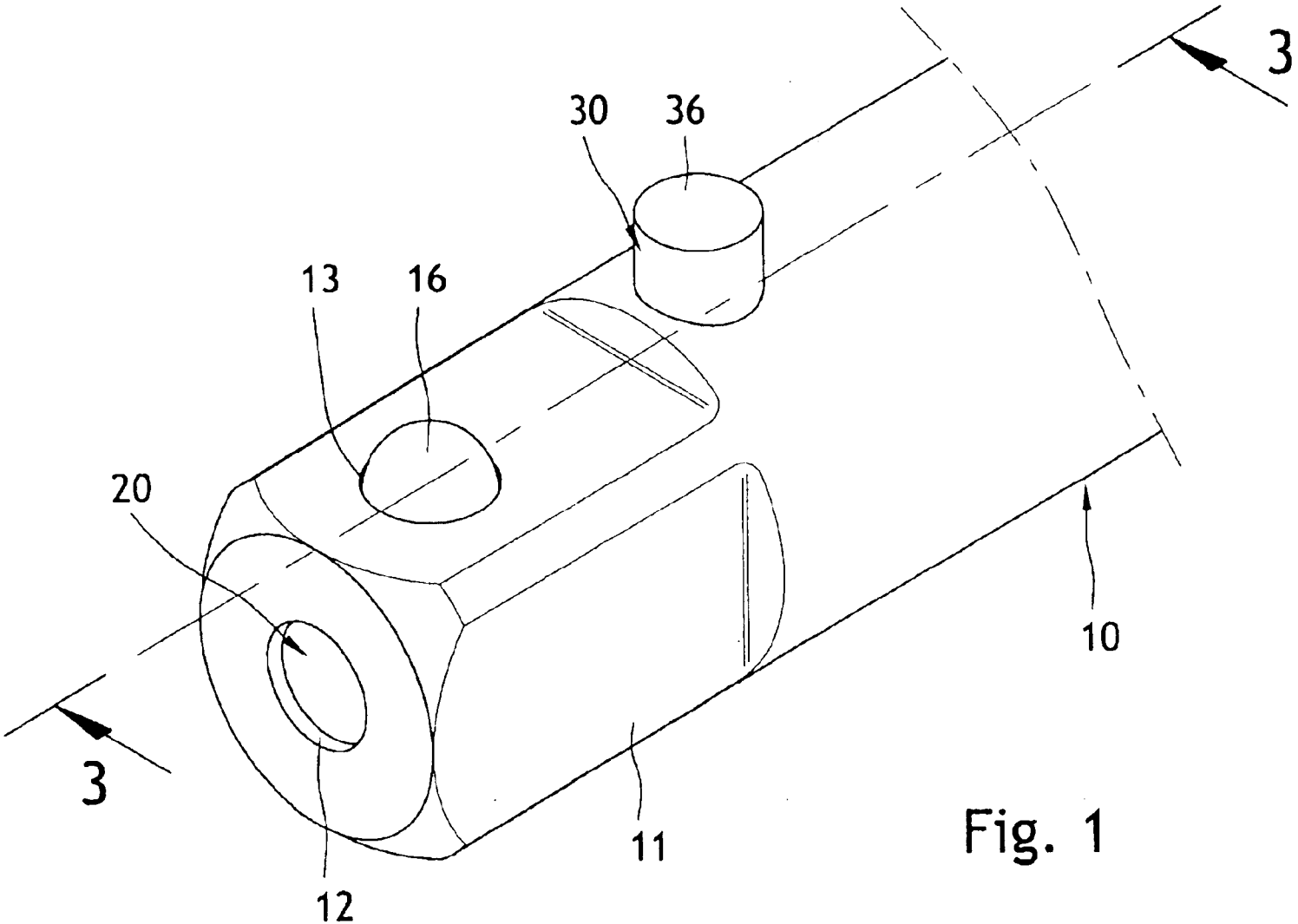
FIG. 1 is a perspective view of a first embodiment of a wrench extension in accordance with the present invention.
Figure 2:
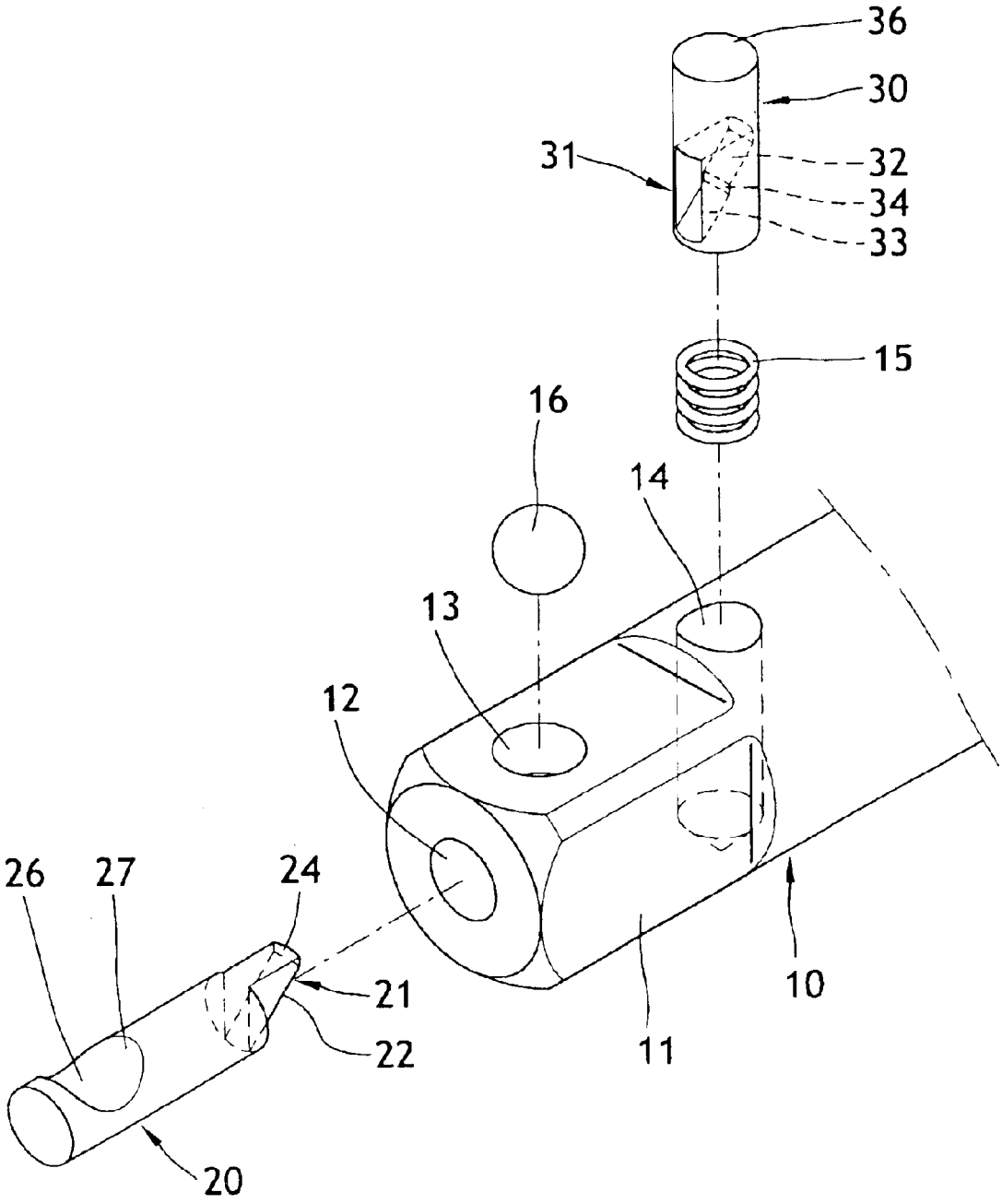
FIG. 2 is an exploded perspective view of the wrench extension in FIG. 1.
Figure 3:
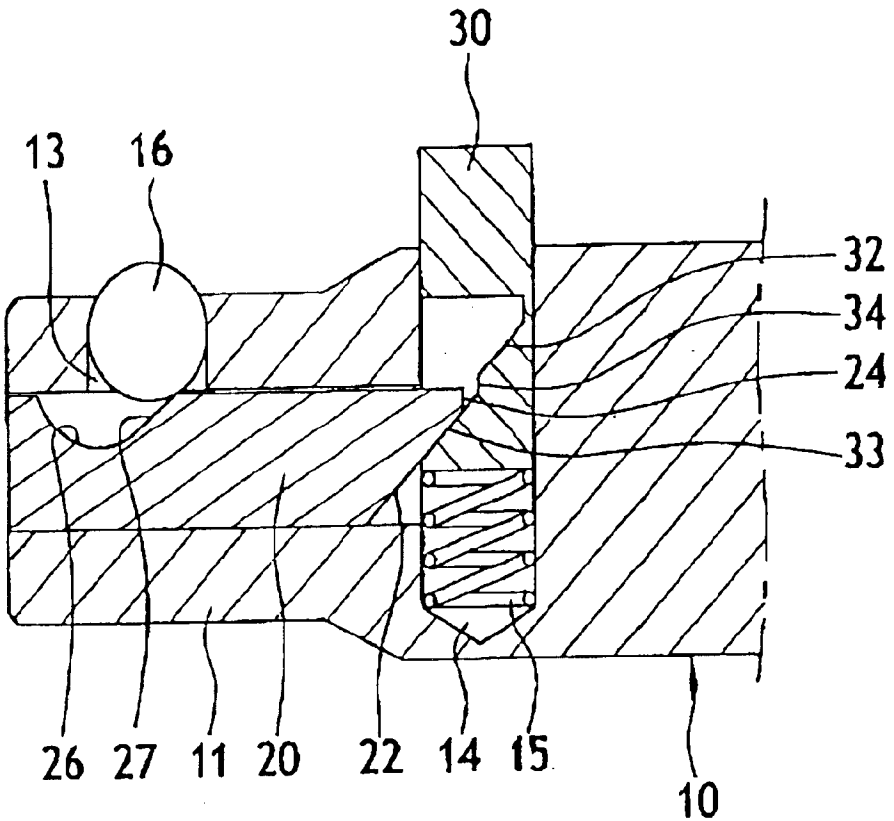
FIG. 3 is a sectional view taken along plane 3—3 in FIG. 1.

Referring to FIGS. 1 through 3, a first embodiment of a wrench extension in accordance with the present invention generally comprises a wrench extension shaft 10 having an end 11 that is generally square for releasably engaging with a socket 40 (FIG. 4) having a cavity 42 with a detent 41. The end 11 of the wrench extension shaft 10 includes an axial passageway 12 extending along a longitudinal direction of the wrench extension shaft 10. Also defined in the end 11 of the wrench extension shaft 10 is a first transverse passageway 13 extending in a direction transverse to the longitudinal direction of the wrench extension shaft 10 and having an inner end communicated with the axial passageway 12 and an outer end communicated with outside. A second transverse passageway 14 is defined in an outer periphery of the wrench extension shaft 10 at a location adjacent to the end 11 of the wrench extension shaft 10. The second transverse passageway 14 extends in a direction transverse to the longitudinal direction of the wrench extension shaft 10 and includes an inner end communicated with the axial passageway 12 and an outer end communicated with outside. Preferably, the second transverse passageway 14 is communicated with the inner end of the axial passageway 12 and extends to an extent to form a receiving portion (not labeled) for receiving an elastic element 15, best shown in FIG. 3.

A transmission member 20 is mounted in the axial passageway 12 and slidable along a longitudinal direction of the axial passageway 12. The transmission member 20 includes a recessed portion 26 on an outer periphery thereof and an inner end 21. The recessed portion 26 includes a tapered curved face 27. The inner end 21 of the transmission member 20 includes a pressing face 24 and a sliding portion. In this embodiment, the sliding portion of the inner end 21 of the transmission member 20 is an inclined sliding face 22 below the pressing face 24. Preferably, the pressing face 24 extends in a direction substantially perpendicular to the longitudinal direction of the axial passage 12. Preferably, the inclined sliding face 22 is at an acute angle with the longitudinal direction of the wrench extension shaft 10.

A push member 30 is mounted in the second transverse passageway 14 and has an operative section 31 facing the inner end 21 of the transmission member 20. The operative section 31 of the push member 30 is a cutout and includes a sliding portion and a pressing face 34. In this embodiment, the sliding portion includes an inclined sliding face 33 below the pressing face 34. The operative section 31 of the push member 30 may further include another inclined sliding face 32 above the pressing face 34. Preferably, the pressing face 34 extends in a direction substantially perpendicular to the longitudinal direction of the axial passage 12. Preferably, the inclined sliding faces 33 and 32 located on two sides of the pressing face 34 are parallel to each other. The push member 30 includes an end 36 for manual operation.

In assembly, as shown in FIGS. 2 and 3, the elastic element 15 and the push member 30 are mounted in the second transverse passageway 14 with the end 36 of the push member 30 being located outside the wrench extension shaft 10 for manual operation. The transmission member 20 is mounted in the axial passageway 12 with the inner end 21 of the transmission member 20 being engaged with the operative section 31 of the push member 30. As illustrated in FIG. 3, the inclined sliding face 22 of the transmission member 20 abuts against the inclined sliding face 33 of the push member 30.

A ball 16 is mounted in the first transverse passageway 13, and a crimping process is carried out to prevent the ball 16 from falling out of the first transverse passageway 13 via the outer end of the first transverse passageway 13. The ball 16 rests on the tapered curved face 27 of the transmission member 20 and partially protrudes beyond the first transverse passageway 13.

Figure 4:
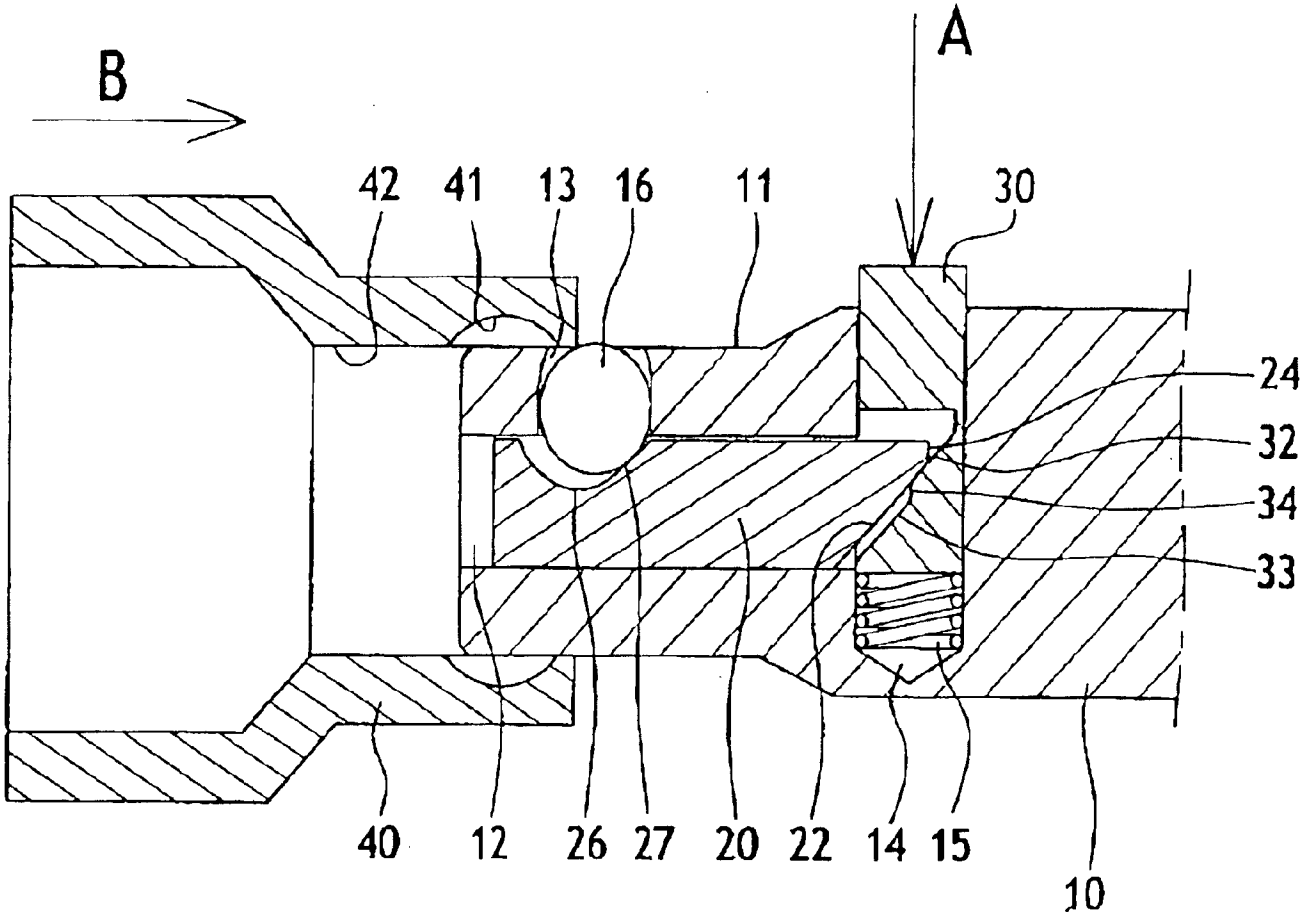
FIG. 4 is a sectional view similar to FIG. 3, illustrating coupling of a socket to the wrench extension.

When coupling a socket 40 to the end 11 of the wrench extension shaft 10, as illustrated in FIG. 4, the push member 30 is pushed along a direction indicated by a vertical arrow A to compress the elastic element 15, and the socket 40 is coupled to the end 11 of the wrench extension shaft 10 along a direction indicated by a horizontal arrow B. The socket 40 moves the protruded portion of the ball 16 into the first transverse passageway 13, which, in turn, causes the transmission member 20 to slide toward the push member 30. As illustrated in FIG. 4, the inclined sliding face 22 of the transmission member 20 slides along the inclined sliding face 32 of the push member 30 while coupling the socket 40 to the end 11 of the wrench extension shaft 10. It is noted that at this time the ball 16 is not on the tapered curved face 27 of the recessed portion 26 of the transmission member 20.

Figure 5:
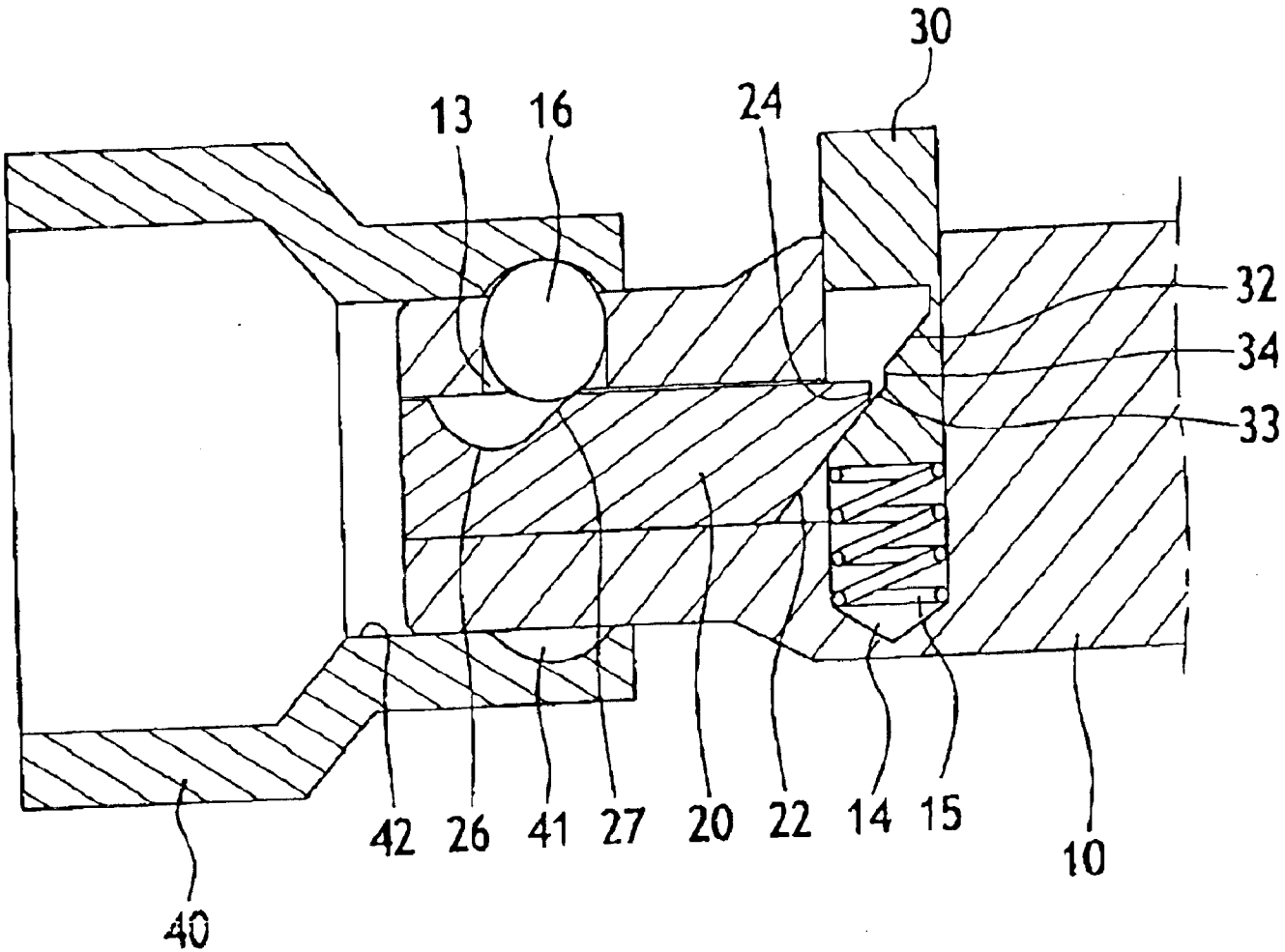
FIG. 5 is a sectional view of the wrench extension and the socket after coupling.

When the socket 40 reaches its position shown in FIG. 5, the push member 30 is released, and the push member 30 is moved upward under the action of the elastic element 15. The inclined sliding face 32 of the push member 30 presses against the inclined sliding face 22 of the transmission member 20. The transmission member 20 is thus moved away from the push member 30 such that the tapered curved face 27 of the recessed portion 26 of the transmission member 20 comes in contact with the ball 16 again. The ball 16 is moved radially away from the transmission member 20 until the ball 16 partially protrudes beyond the first transverse passageway 13 into the detent 41 in the cavity 42 of the socket 40. Thus, the socket 40 is coupled to the end 11 of the wrench extension shaft 10.

Since the detent 41 of the socket 40 has tolerance as a nature of manufacture, the actual depths of the detents 41 of the sockets 40 made by same or different manufacturers may different from one another. The arrangement of the tapered curved face 27 of the recessed portion 26 of the transmission member 20 and the mutual sliding engagement between inclined sliding face 23 of the transmission member 20 and the inclined sliding face 33 of the push member 30 under the action of the elastic element 15 would move the transmission member 20 away from the push member 30 to a position where the tapered curved face 27 of the recessed portion 26 of the transmission member 20 would push the ball 16 outward into the detent 41 of the socket 40, thereby providing reliable engagement between the socket 40 and the end 11 of the wrench extension shaft 10. Namely, the tapered curved face 27 of the transmission member 20 provides an automatic compensation to the tolerance of the detent 41 of the socket 40, thereby ensuring reliable coupling of the socket 40 to the end 11 of the wrench extension shaft 10.

Figure 6:
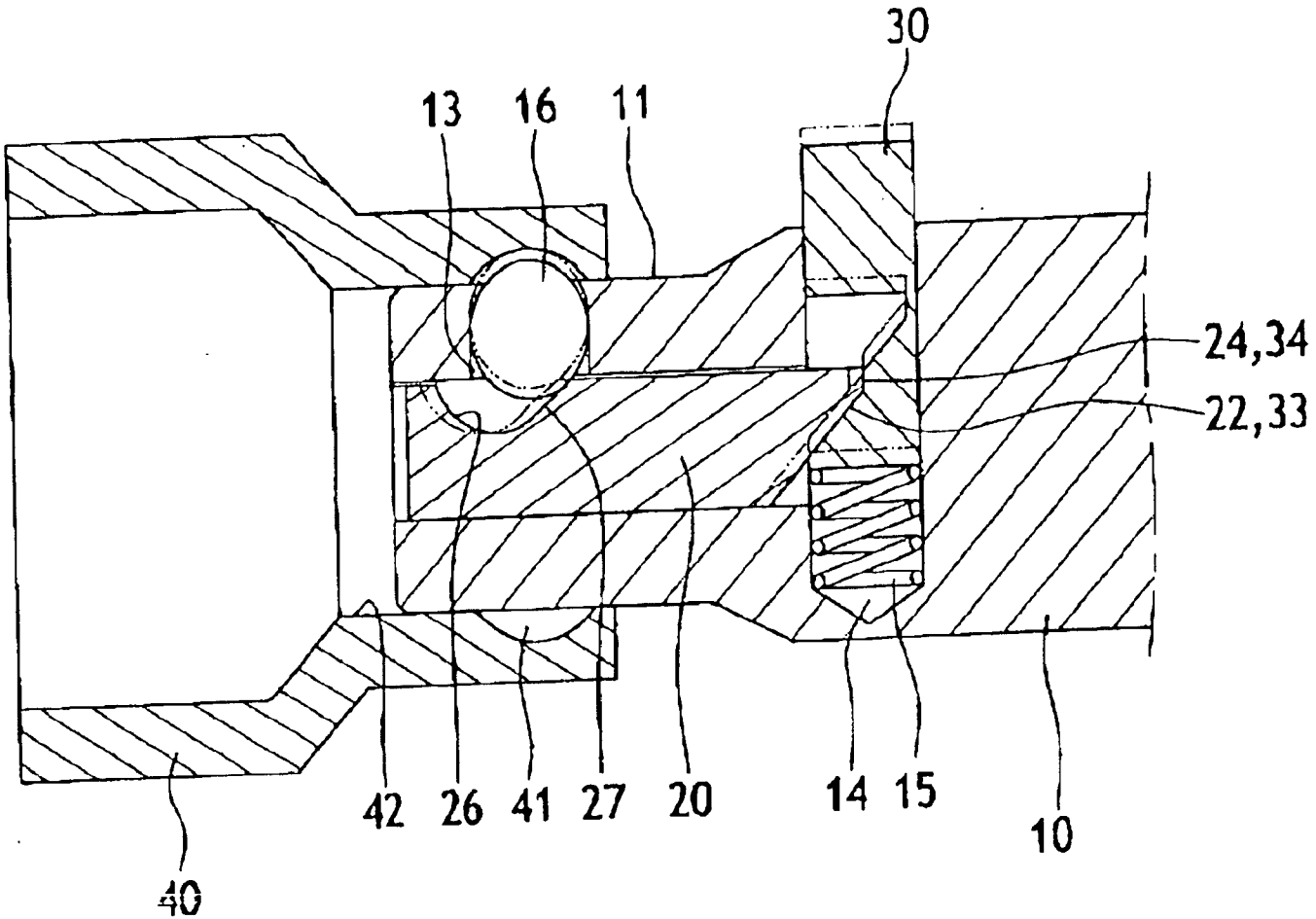
FIG. 6 is a sectional view similar to FIG. 5, illustrating automatic compensation to a different depth of a detent of the socket coupled to the wrench extension.

More specifically, when a socket having a detent of a small depth is coupled to the end 11 of the wrench extension shaft 10, as illustrated in FIG. 6, the pressing face 24 of the transmission member 20 abuts against the pressing face 34 of the push member 30, and the inclined sliding face 22 of the transmission member 20 abuts against the inclined sliding face 33 of the push member 30. The ball 16 is moved radially outward into the cavity 41 of the socket 40 under the action of the elastic element 15 cooperating with the inclined sliding face 22 of the transmission member 20 and the inclined sliding face 33 of the push member 30. The cavity 41 of the socket 40 is almost completely occupied by the ball 16 to thereby provide a reliable coupling between the socket 40 and the end 11 of the wrench extension shaft 10 (see the solid lines in FIG. 6).

Still referring to FIG. 6, when a socket having a detent of a deeper depth is coupled to the end 11 of the wrench extension shaft 10, the ball 16 is further radially moved outward farther into the cavity 41 of the socket 40 under the action of the elastic element 15 cooperating with the inclined sliding face 22 of the transmission member 20 and the inclined sliding face 33 of the push member 30 (see the phantom lines in FIG. 6). As a result, the pressing face 24 of the transmission member 20 is disengaged from the pressing face 34 of the push member 30. The inclined sliding face 22 of the transmission member 20 is still engaged with the inclined sliding face 33 of the push member 30. The cavity 41 of the socket 40 is almost completely occupied by the ball 16 to thereby provide a reliable coupling between the socket 40 and the end 11 of the wrench extension shaft 10. Thus, the socket-coupling system in accordance with the present invention allows the wrench extension shaft 10 to be used with all sockets manufactured by same or different manufacturers regardless of the tolerance.

Figure 7:
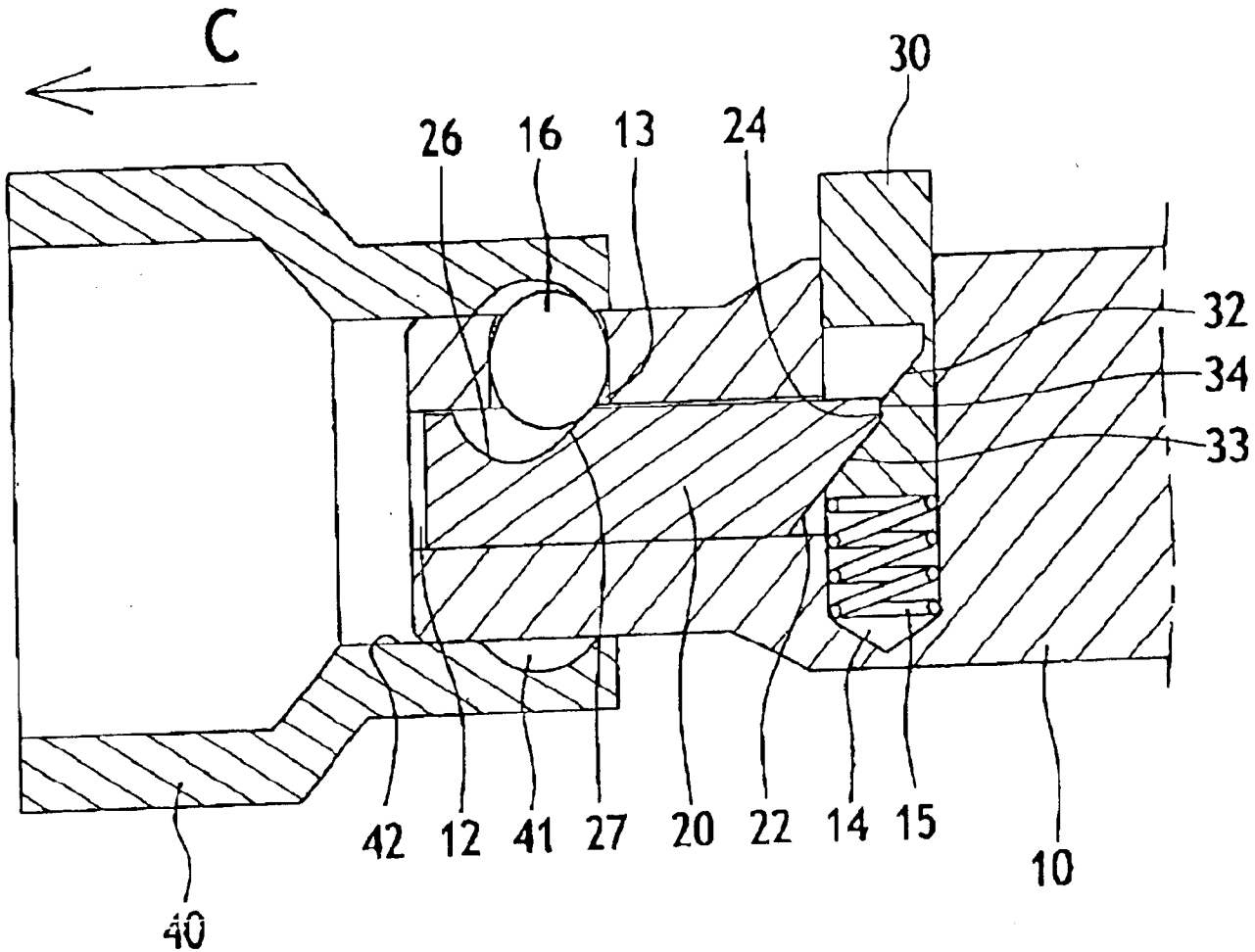
FIG. 7 is a sectional view illustrating prevention of forcible detaching of the socket from the wrench extension.

When the socket 40 is subject to an external force indicated by an arrow C in FIG. 7, sliding movement of the transmission member 20 toward the push member 30 is stopped, as the pressing face 24 of the inner end 21 of the transmission member 20 presses against and is thus stopped by the pressing face 34 of the push member 30. Thus, the ball 16 could not move out of the tapered curved face 27 of the recessed portion 26 of the transmission member 20. Namely, the ball 16 is still in reliable engagement with the detent 41 of the socket 40, preventing the socket 40 from being disengaged from the end 11 of the wrench extension shaft 10.

Figure 8:
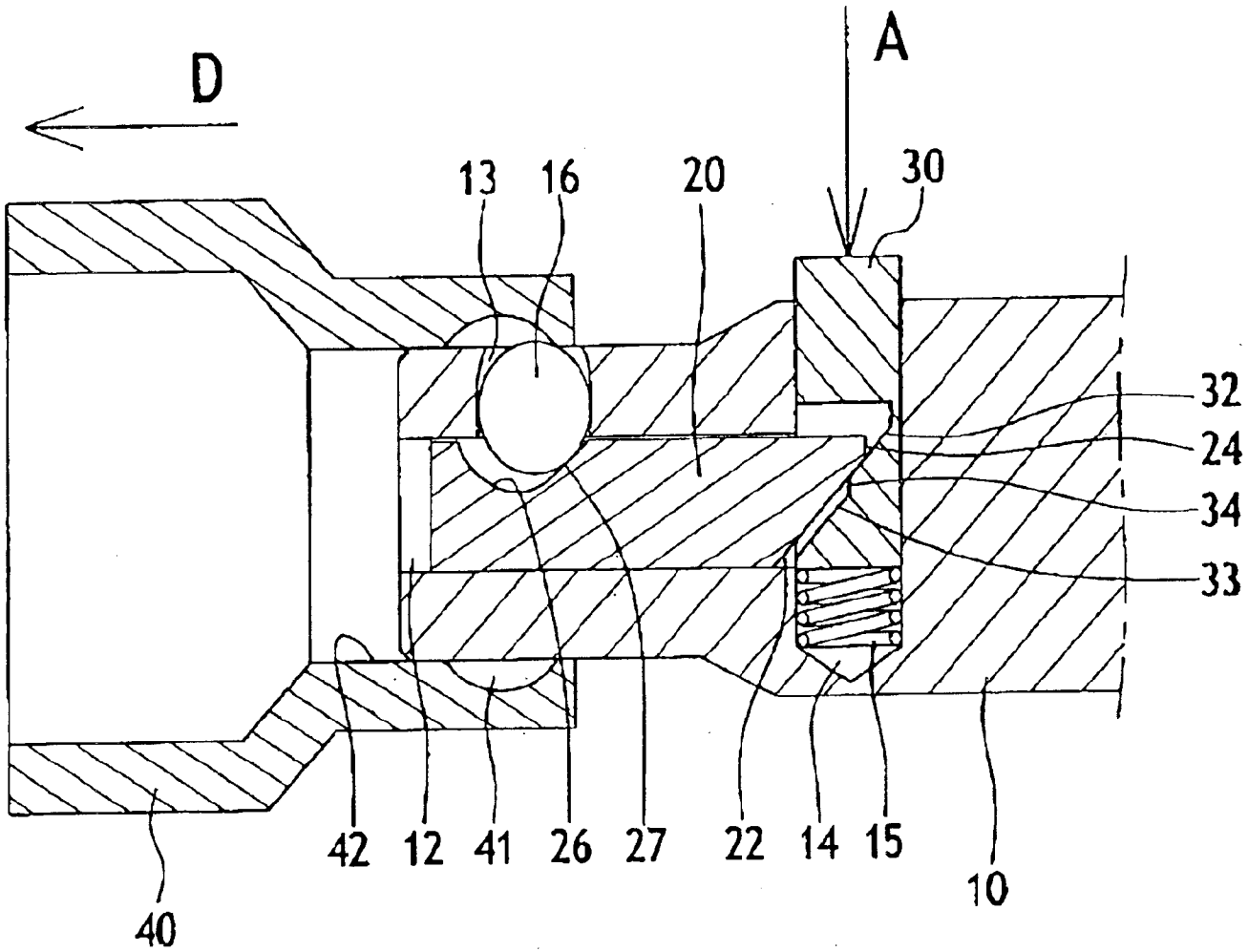
FIG. 8 is a sectional view illustrating normal detaching of the socket from the wrench extension.

FIG. 8 illustrates normal detaching of the socket 40 from the wrench extension shaft 10. The push member 20 is pushed along a direction indicated by an arrow A to compress the elastic element 15, and the socket 40 is moved in a direction indicated by an arrow D. The ball 16 is allowed to move inward, as the transmission member 20 is now allowed to move toward the push member 30.

Figure 9:
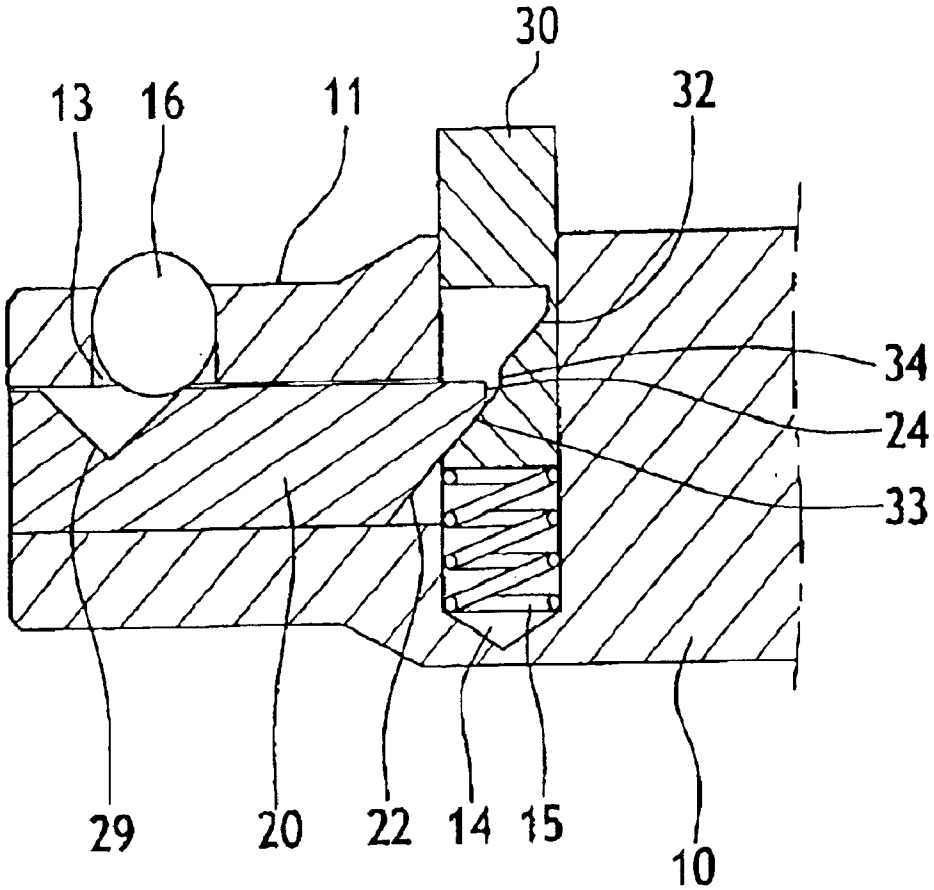
FIG. 9 is a sectional view illustrating a modified embodiment of the wrench extension in accordance with the present invention.

The recessed portion 26 with a tapered curved face 27 of the transmission member 20 can be replaced with other configurations, and an example of which is shown in FIG. 9 in which a V-shaped groove 29 is defined in the periphery of the transmission member 20. The V-shaped groove 29 may also achieve the function of automatic compensation of the tolerance of the detent 41 of the cavity 42 of the socket 40 under cooperation of the associated elements, as mentioned in the above embodiments. Further, the ball 16 in all of the embodiments can be replaced with other suitable latch without adversely affecting its function.

Figure 10:
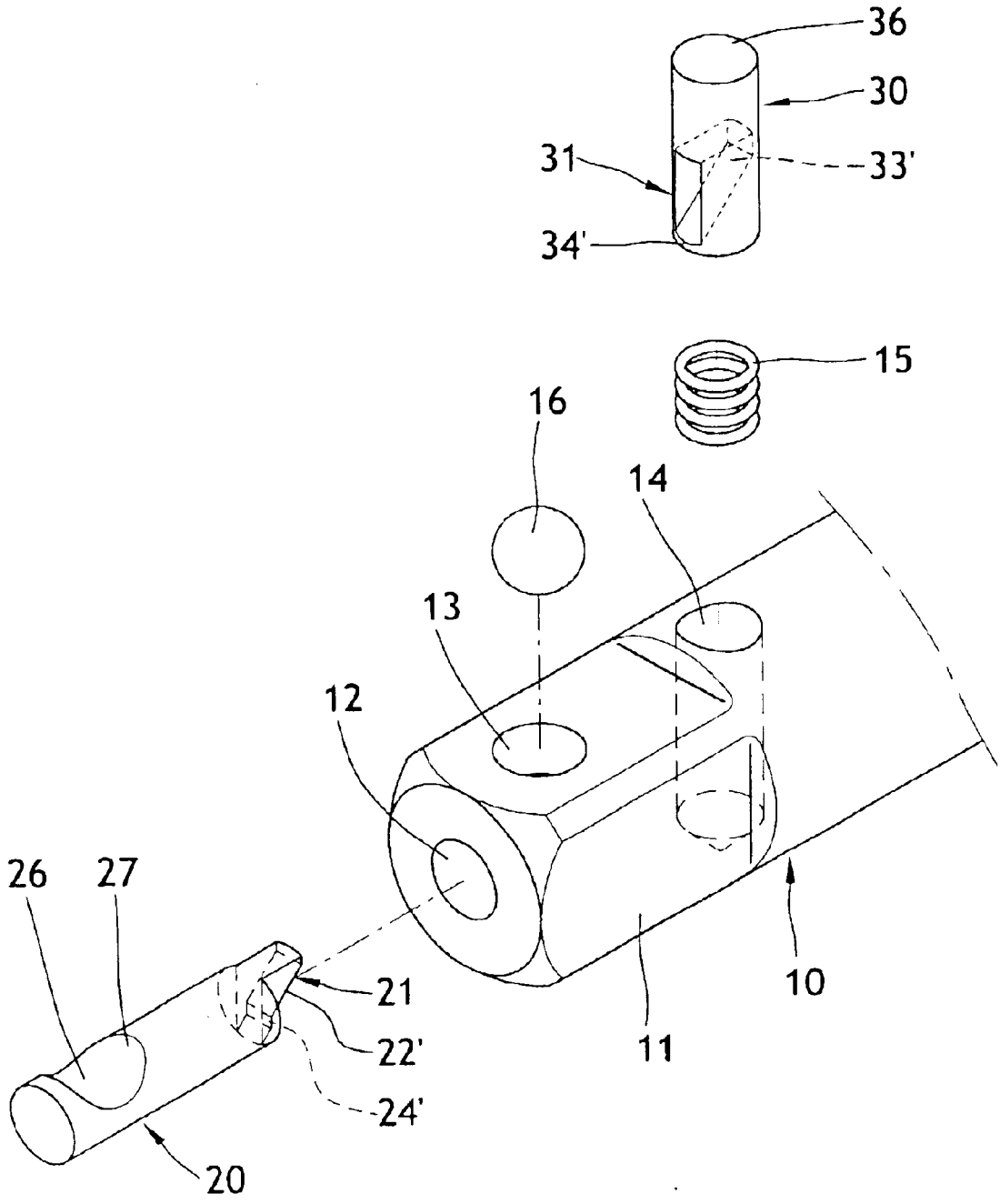
FIG. 10 is an exploded perspective view illustrating another modified embodiment of the wrench extension in accordance with the present invention.
Figure 11:
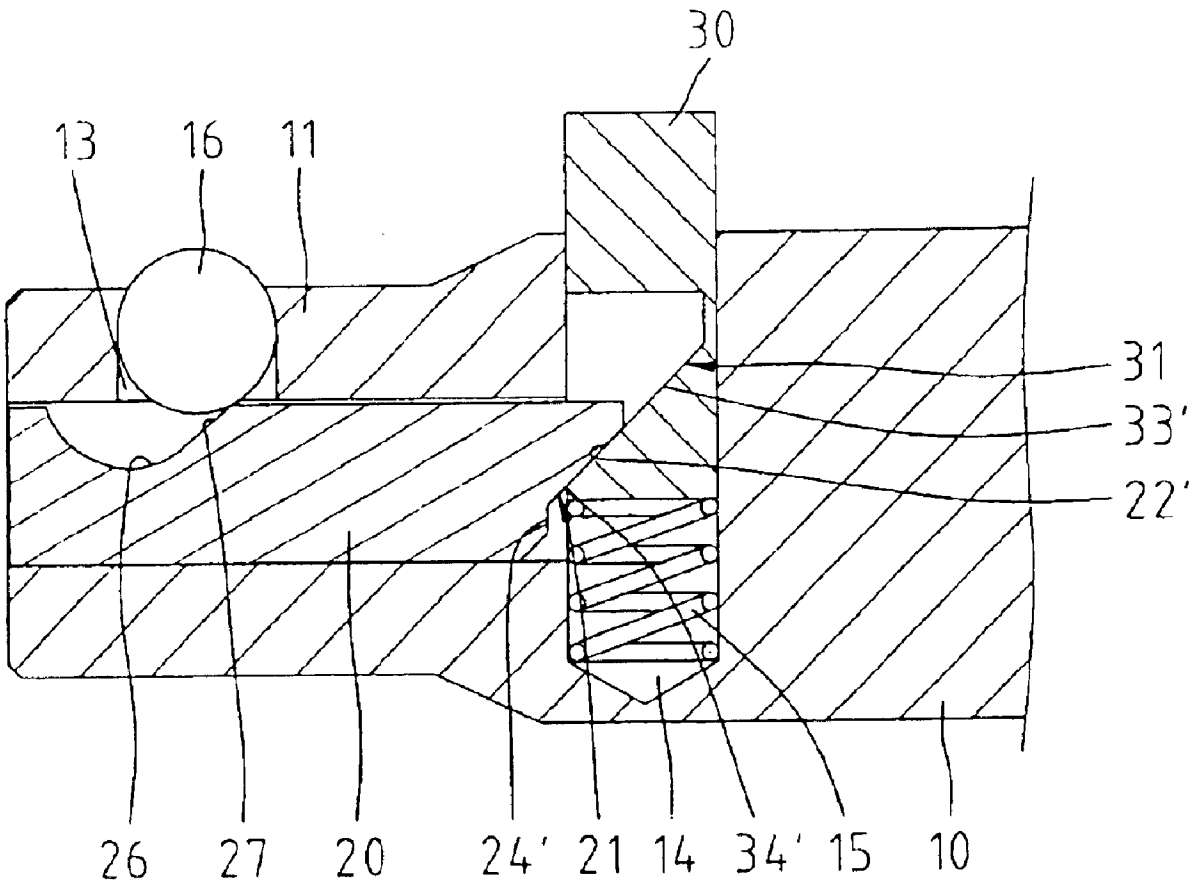
FIG. 11 is a sectional view of the wrench extension in FIG. 10.
Figure 12:
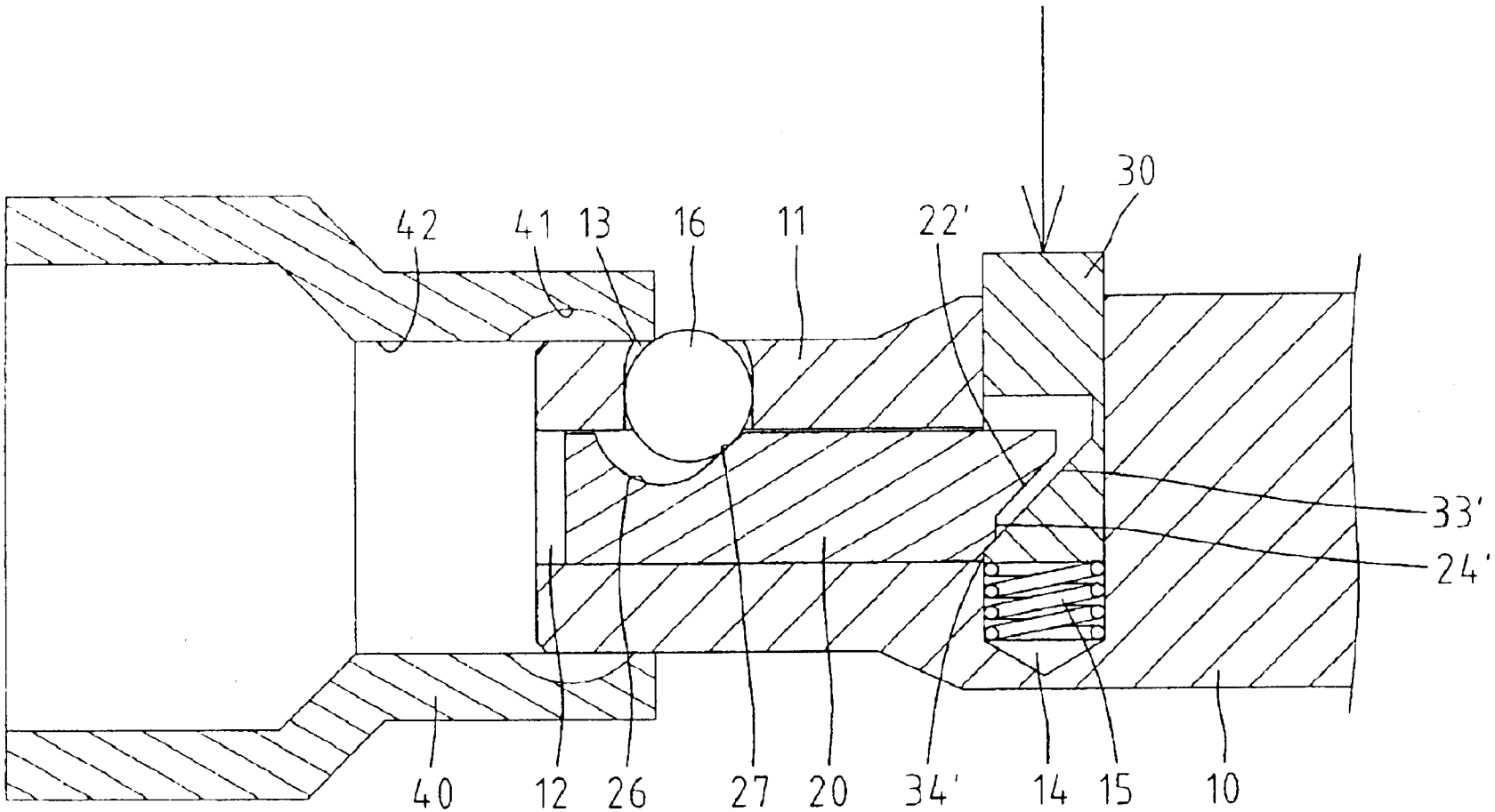
FIG. 12 is a sectional view similar to FIG. 11, illustrating coupling of a socket to the wrench extension in FIG. 11.

FIGS. 10 through 12 illustrate another modified embodiment of the wrench extension in accordance with the present invention, wherein the inclined sliding face (now designated by 33') and the pressing face (now designated by 34') of the operative section 31 of the push member 30 are arranged in an upside-down manner when compared with the first embodiment shown in FIGS. 1 through 7. Corresponding to the change in the operative section 31 of the push member 30, the inclined sliding face (now designated by 22') and the pressing face (24') of the transmission member 20 are arranged in an upside-down manner to cooperate with the inclined sliding face 33' and the pressing face 34' of the operative section 31 of the push member 30. Operation of this embodiment is similar to that of the first embodiment.

Figure 13:
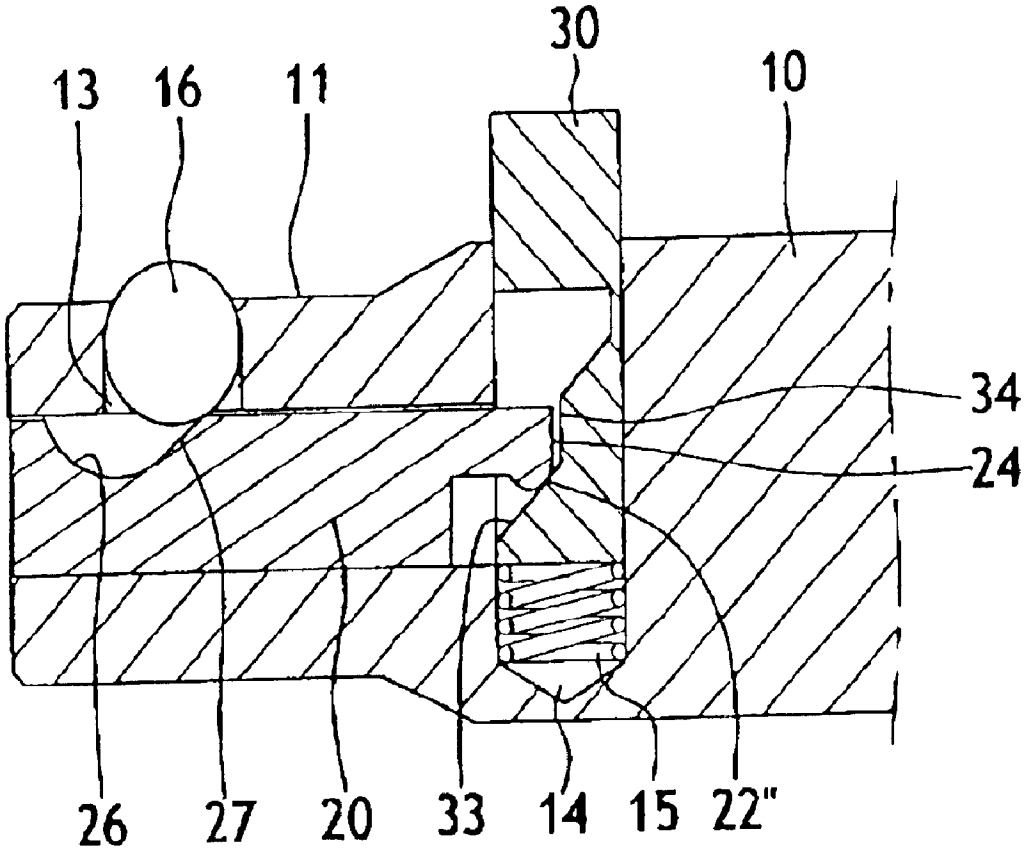
FIG. 13 is a sectional view illustrating a further modified embodiment of the wrench extension in accordance with the present invention.

FIG. 13 illustrates a further modified embodiment of the wrench extension in accordance with the present invention, wherein the sliding portion of the transmission member 20 is in the form of an end edge or protrusion 22" without adversely affecting its function.

Figure 14:
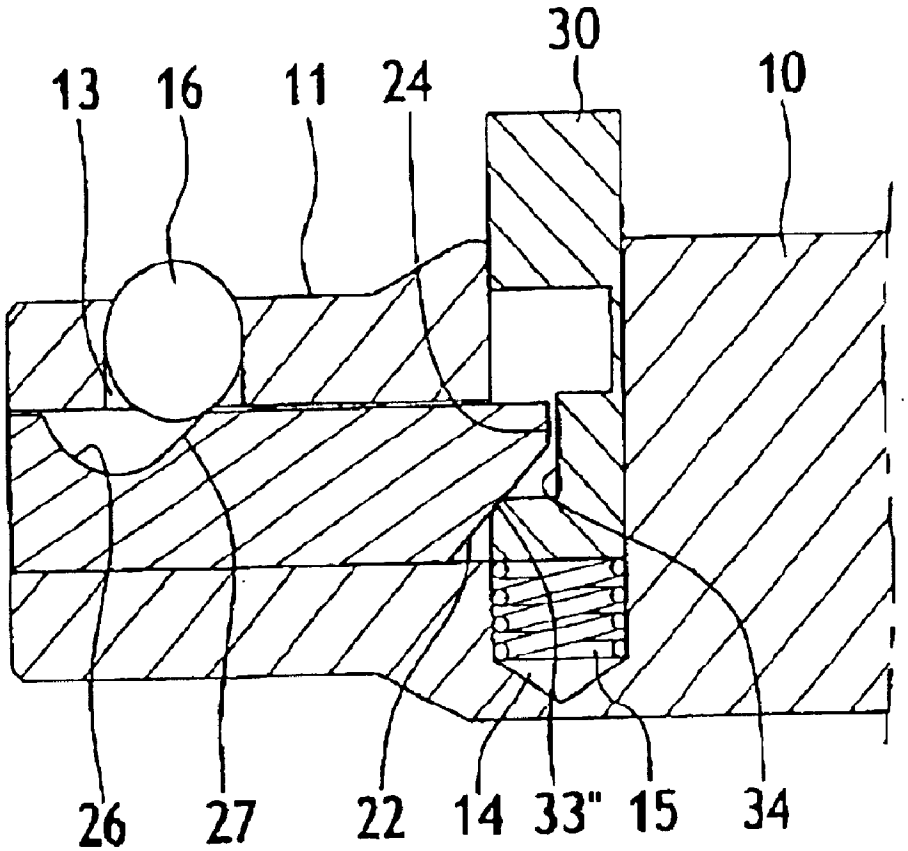
FIG. 14 is a sectional view illustrating still another modified embodiment of the wrench extension in accordance with the present invention.

FIG. 14 illustrates still another modified embodiment of the wrench extension in accordance with the present invention, wherein the sliding portion of the push member 30 is in the form of an end edge or protrusion 33" without adversely affecting its function.

Although the invention has been explained in relation to its preferred embodiments, it is to be understood that many other possible modifications and variations can be made without departing from the scope of the invention as hereinafter claimed.

What is claimed is:

1. A socket-coupling system comprising:

a wrench extension shaft including an end, the end including an axial passageway extending along a longitudinal direction of the wrench extension shaft, the end further including a first transverse passageway extending in a direction transverse to the longitudinal direction of the wrench extension shaft, the first transverse passageway including an inner end communicated with the axial passageway and an outer end communicated with outside, the wrench extension shaft further including a second transverse passageway defined in an outer periphery thereof and extending in a direction transverse to the longitudinal direction of the wrench extension shaft, the second transverse passageway being communicated with the axial passageway and having an outer end communicated with outside;

a transmission member mounted in the axial passageway and slidable along the longitudinal direction of the wrench extension shaft, the transmission member including a recessed portion in an outer periphery thereof, the inner end of the transmission member including a sliding portion;

a latch partially received in the first transverse passageway and movable along an extending direction of the first transverse passageway, the latch being partially received in the recessed portion of the transmission member;

a push member mounted in the second transverse passageway and slidable along an extending direction of the second transverse passageway, the push member including an operative section having a sliding portion in sliding engagement with the sliding portion of the transmission member allowing mutual sliding movement between the sliding portion of the push member and the sliding portion of the transmission member; and an elastic element mounted in the second transverse passageway for biasing the push member to an undepressed position;

at least one of the sliding portion of the transmission member and the sliding portion of the push member being a planar inclined surface;

one of the push member and the inner end of the transmission member including a pressing face;

wherein when the push member is pushed and a socket is coupled to the end of the wrench extension shaft, the latch is moved inward to allow passage of the socket, and the transmission member is moved by the latch along the longitudinal direction of the wrench extension shaft, and when the push member is released, the transmission member is moved along the longitudinal direction of the wrench extension shaft in response to movement of the push member under action of the elastic element until the recessed portion of the transmission member urges the latch to protrude into a detent of a cavity of the socket coupled to the end of the wrench extension shaft; and wherein when the socket is subject to a force along the longitudinal direction of the wrench extension shaft for moving the socket away from the end of the wrench extension shaft, the pressing face on said one of the push member and the inner end of the transmission member being stopped by the other of the push member and the inner end of the transmission member, thereby preventing further movement, of the transmission member along the longitudinal direction of the wrench extension shaft and reliably retaining a protruded portion of the latch in the detent of the socket.

2. The socket-coupling system as claimed in claim 1, wherein the latch is a ball.

3. The socket-coupling system as claimed in claim 1, wherein the recessed portion of the transmission member includes a tapered curved face.

4. The socket-coupling system as claimed in claim 1, wherein the recessed portion of the transmission member is a V-shaped groove.

5. The socket-coupling system as claimed in claim 1, wherein the sliding portion of the transmission member is a protrusion.

6. The socket-coupling system as claimed in claim 1, wherein the sliding portion of the push member is a protrusion.

7. The socket-coupling system as claimed in claim 1, wherein the pressing face extends in a direction substantially perpendicular to the longitudinal direction of the wrench extension shaft.

8. The socket-coupling system as claimed in claim 1, wherein the pressing face is provided on the inner end of the transmission member.

9. The socket-coupling system as claimed in claim 8, wherein the pressing face is above the sliding portion of the transmission member.

10. The socket-coupling system as claimed in claim 8, wherein the pressing face is below the sliding portion of the transmission member.

11. The socket-coupling system as claimed in claim 1, wherein the pressing face is provided on the operative section of the push member.

12. The socket-coupling system as claimed in claim 11, wherein the pressing face is above the sliding portion of the push member.

13. The socket-coupling system as claimed in claim 11, wherein the pressing face is below the sliding portion of the push member.

14. A socket-coupling system comprising:

a wrench extension shaft including an end, the end including an axial passageway extending along a longitudinal direction of the wrench extension shaft, the end further including a first transverse passageway extending in a direction transverse to the longitudinal direction of the wrench extension shaft, the first transverse passageway including an inner end communicated with the axial passageway and an, outer end communicated with outside, the wrench extension shaft further including a second transverse passageway defined in an outer periphery thereof and extending in a direction transverse to the longitudinal direction of the wrench extension shaft, the second transverse passageway being communicated with the axial passageway and having an outer end communicated with outside;

a transmission member mounted in the axial passageway and slidable along the longitudinal direction of the wrench extension shaft, the transmission member including a recessed portion in an outer periphery thereof, the transmission member further including an inner end having a pressing face extending along a direction substantially perpendicular to a longitudinal direction of the wrench extension shaft, the inner end of the transmission member further including a planar inclined sliding face at an acute angle with the longitudinal direction of the wrench extension shaft;

a latch partially received in the first transverse passageway and movable along an extending direction of the first transverse passageway, the latch being partially received in the recessed portion of the transmission member;

a push member mounted in the second transverse passageway and slidable along an extending direction of the second transverse passageway, the push member including an operative section having a pressing face extending in a direction perpendicular to the longitudinal direction of the wrench extension shaft, the operative section of the push member further including a planar inclined sliding face in sliding engagement with the planar inclined sliding face of the transmission member allowing mutual sliding movement between the planar inclined sliding face of the push member and the planar inclined sliding face of the transmission member; and an elastic element mounted in the second transverse passageway for biasing the push member to an undepressed position;

wherein when the push member is pushed and a socket is coupled to the end of the wrench extension shaft, the latch is moved inward to allow passage of the socket, and the transmission member is moved by the latch along the longitudinal direction of the wrench extension shaft, and when the push member is released, the transmission member is moved along the longitudinal direction of the wrench extension shaft in response to movement of the push member under action of the elastic element until the recessed portion of the transmission member urges the latch to protrude into a detent of a cavity of the socket coupled to the end of the wrench extension shaft; and wherein when the socket is subject to a force along the longitudinal direction of the wrench extension shaft for moving the socket away from the end of the wrench extension shaft, the pressing face of the transmission member is stopped by the pressing face of the push member, thereby preventing further movement of the transmission member along the longitudinal direction of the wrench extension shaft and reliably retaining a protruded portion of the latch in the detent of the socket.

15. The socket-coupling system as claimed in claim 14, wherein the latch is a ball.

16. The socket-coupling system as claimed in claim 14, wherein the recessed portion of the transmission member includes a tapered curved face.

17. The socket-coupling system as claimed in claim 14, wherein the recessed portion of the transmission member is a V-shaped groove.

18. The socket-coupling system as claimed in claim 14, wherein the operative section of the push member further includes a second inclined sliding face, the inclined sliding face and the second inclined sliding face of the push member being respectively located on two sides of the pressing face of the push member, the planar inclined sliding face of the transmission member sliding along the second inclined face of the push member when the push member is pushed and the socket is being coupling to the end of the wrench extension shaft.

19. The socket-coupling system as claimed in claim 14, wherein the pressing face of the transmission member is above the planar inclined sliding face of the transmission member, and wherein the pressing face of the push member is above the inclined sliding face of the push member.

20. The socket-coupling system as claimed in claim 14, wherein the pressing face of the transmission member is below the planar inclined sliding face of the transmission member, and wherein the pressing face of the push member is below the inclined sliding face of the push member.

* * * * *